United States Patent [19]

Jamrozy et al.

[11] Patent Number: 4,949,646

[45] **Date of Patent: * Aug. 21, 1990**

[54] CONTAINER CARRYING RAILROAD CAR WITH IMPROVED SUPPORT SYSTEM

[76] Inventors: Richard E. Jamrozy, 3419 170th St., Lansing, Ill. 60438; Shaun Richmond, 9151 Sunrise La., Orland Park, Ill. 60462

[ * ] Notice: The portion of the term of this patent subsequent to Mar. 20, 2007 has been disclaimed.

[21] Appl. No.: 405,145

[22] Filed: Sep. 7, 1989

Related U.S. Application Data

[63] Continuation of Ser. No. 180,316, Apr. 11, 1988, Pat. No. 4,909,157, which is a continuation-in-part of Ser. No. 890,284, Jul. 29, 1986, Pat. No. 4,771,706.

[51] Int. Cl.[5] ..... B61D 3/20; B61D 17/00; B60P 1/64

[52] U.S. Cl. ..... 105/406.1; 105/415; 105/411; 410/52

[58] Field of Search ..... 105/4.1, 406.1, 411, 105/414, 415, 416; 410/52, 56, 94; 296/30

[56] References Cited

U.S. PATENT DOCUMENTS

| | | | |
|---|---|---|---|
| 2,901,986 | 9/1959 | Furrer | 410/56 |
| 3,238,899 | 3/1966 | Gutridge et al. | 105/414 |
| 3,357,371 | 12/1967 | Gutridge | 105/414 X |
| 3,818,843 | 6/1974 | Lee | 410/68 |
| 4,091,742 | 5/1978 | Cordani | 105/406.1 X |
| 4,456,413 | 6/1984 | Pavlick | 105/4.1 X |
| 4,686,907 | 8/1987 | Woollam et al. | 105/416 X |
| 4,718,353 | 1/1988 | Schuller et al. | 105/406.1 |
| 4,754,709 | 7/1988 | Gramse et al. | 410/54 X |
| 4,771,706 | 9/1988 | Lindauer et al. | 105/415 |
| 4,782,762 | 11/1988 | Johnstone | 105/411 X |

FOREIGN PATENT DOCUMENTS

| | | | |
|---|---|---|---|
| 3711409 | 10/1987 | Fed. Rep. of Germany | 105/414 |

*Primary Examiner*—Sherman D. Basinger
*Assistant Examiner*—James M. Kannofsky

[57] ABSTRACT

A railroad car, for carrying shipping containers, having a car body with opposing side walls and an end wall near each end defining a well in which a container can be received; support for a container, when in the well, comprising a plurality of spaced metal reinforcing elements or castings joined to each side wall and spaced inwardly from the well end walls; and each casting being substantially L-shaped and having a substantially vertical leg joined at the bottom of a side wall and the casting having an arm extending laterally substantially horizontally inwardly toward the center of the car to aid in supporting a container in the well.

33 Claims, 3 Drawing Sheets

CONTAINER CARRYING RAILROAD CAR WITH IMPROVED SUPPORT SYSTEM

This application is a continuation-in-part of copending application Ser. No. 890,284 filed July 29, 1986, the entire contents of which is incorporated herein by reference.

This invention relates to railroad cars. More particularly, this invention is concerned with an improved railroad car for carrying cargo containers.

BACKGROUND OF THE INVENTION

Railroad box cars have been in use for many years transporting a wide variety of cargo. Box cars are recognized as being primarily useful when the cargo can be loaded directly in the car from a siding adjacent its production without any prior shipping involving substantial labor in loading and unloading the goods, as from a truck. The same applies at the shipping destination.

In recent years it has been found increasingly efficient to ship cargo in large containers by sea, railroad and highway. Shipping in this manner avoids unpacking the cargo between the time the container is packed by the shipper and received by the customer thereby avoiding extra labor, breakage, and theft in handling and reducing delivery time. These benefits are realized because the containers are sized and shaped to be carried by highway trucks and trailers, special railroad cars and container carrying ships.

One type of railroad car which is particularly suitable for carrying containers is referred to as a well car. Such a car has side and end walls and a partial or full floor thereby defining a well or recessed space into which one or more containers can be longitudinally positioned. The container sides are generally at least two to three times higher than the depth of the well space. Additionally, the containers can be double stacked when desired to increase the shipping load.

Well cars of the described type suitable for carrying containers, and also highway trailers, are disclosed in U.S. Pat. Nos. 4,091,742; 4,400,121; and 4,456,413.

To support a container in the well space, horizontal flanges or ledges are positioned along the bottom portions of the side walls so as to extend inwardly toward the car center. The lower side corners of the containers rest on these flanges or ledges and receive most of the container load. It has been found that container supports of the described type, which are usually fabricated of welded elements, bend and fail in use. A need accordingly exists for an improved support system for containers in well cars.

SUMMARY OF THE INVENTION

According to the invention a well car for carrying containers is provided comprising a car body supported by rail truck means adapted for movement over a railroad; the car body having opposing side walls and an end wall near each end connected to the side walls with said side walls and end walls defining a well in which a container can be received; means for supporting the bottom of a container, when in the well, comprising a plurality of metal reinforcing elements or castings joined to each side wall; and with each casting having a substantially vertical leg joined at the bottom of a side wall with an arm extending substantially horizontally laterally inwardly toward the center of the car on which a container bottom can be supported.

The arm and leg can each have a length of about nine to twenty-four inches, but generally will be about twelve to eighteen inches long.

A casting can be located near each side wall end opposite a casting on the other side wall with a lateral cross brace connected to the arms of said opposing castings.

The car can also have a longitudinal structural angle member secured along the lower inner portion of each side wall. While the angle member can have a vertical flange joined to the casting leg and a horizontal flange joined to the casting arm, it is generally desirable not to join the casting to the structural angle member so that both of these members can flex longitudinally and laterally independently, when a load is applied so as to increase their fatigue life. Also, if these members are joined together by unnecessary weldments, such weldments may fail and actually lead to avoidable failure of the casting.

Each car side wall can have vertical braces and the leg of each casting can be joined to the bottom of one of the vertical braces.

According to one aspect of the invention a railroad car for carrying containers is provided comprising a car body supported by rail truck means adapted for movement over a railroad; the car body having opposing side walls and an end wall near each end connected to the side walls with said side walls and end walls defining a well in which a container can be received; means for supporting the bottom of a container, when in the well, comprising a plurality of spaced metal castings joined to each side wall and spaced inwardly from the well end walls; each casting being substantially L-shaped and having a substantially vertical leg joined at the bottom of a side wall and the casting having an arm extending laterally substantially horizontally inwardly toward the center of the car to aid in supporting a container in the well; the casting vertical leg having inner and outer substantially vertical spaced apart flanges longitudinal to an adjoining car body side wall and at least two spaced apart substantially vertical webs lateral to and joined to the flanges thereby defining a vertical pocket open at the top and extending downwardly for less than the length of the leg; the casting lateral horizontal arm having top and bottom substantially horizontal spaced apart flanges and at least two spaced apart substantially vertical webs joined to the flanges thereby defining a horizontal pocket open at the end of the arm and extending horizontally inwardly from the arm end for less than the length of the arm.

The leg can have at least three spaced apart vertical webs joined to the inner and outer flanges thereby describing at least two vertical pockets or the leg can have at least four spaced apart vertical webs joined to the inner and outer flanges thereby describing at least three vertical pockets.

The arm can have at least three spaced apart vertical webs joined to the top and bottom flanges thereby describing at least two horizontal pockets or the arm can have at least four spaced apart vertical webs joined to the inner and outer flanges thereby describing at least three horizontal pockets.

The leg inner flange can merge into the arm top flange and the leg outer flange can merge into the arm bottom flange.

A plurality of spaced apart substantially vertical fingers can extend upwardly from the leg inner flange top and the fingers can be joined to the side wall. The fingers can be extensions of the inner flange and each finger can be reinforced by an extension of a leg vertical web.

The casting can have a solid corner block of metal for the width of the casting where the leg and arm merge, with said solid block of metal extending to and forming the bottoms of the leg and arm pockets.

A casting can be located near each well side wall end opposite a casting on the other well side wall and a lateral crossbeam can be connected to the arms of said opposing castings.

Each well side wall can have vertical braces outside of the well and the leg of each casting can be joined to a vertical brace vertically aligned with the leg. Also, the top of the leg can telescope into the vertical brace The vertical webs in the casting leg and the casting arm can be aligned with each other and pairs of such aligned webs can form casting side walls on the leg and the arm. The leg outer flange and the arm bottom flange terminate at the said casting side walls and the leg inner flange and the arm top flange can extend beyond the said casting side walls.

A longitudinal horizontal structural angle member having a vertical flange and a horizontal flange can extend along the bottom of each side wall with the vertical flange joined to the side wall and the horizontal flange supported by the casting arm.

The structural angle member vertical flange can be close to but spaced from and not joined to the leg of the casting described herein or any other suitable casting such as described in pending application Ser. No. 890,284 filed July 29, 1986, the entire contents of which is incorporated herein by reference. The angle member horizontal flange bottom edge portion can contact the arm of the casting top web described herein or the casting described in said application Ser. No. 890,284, but the horizontal flange and the casting top web otherwise can be out of contact with each other and not joined together.

Use of the described casting is not limited to container-carrying well cars since it can be used in other types of railroad cars and even in over-the-highway vehicles and trailers.

DETAILED DESCRIPTION OF THE DRAWINGS

To the extent it is reasonable and practical the same or similar elements or parts appearing in the various views of the drawings will be identified by the same numbers.

Figure 1:
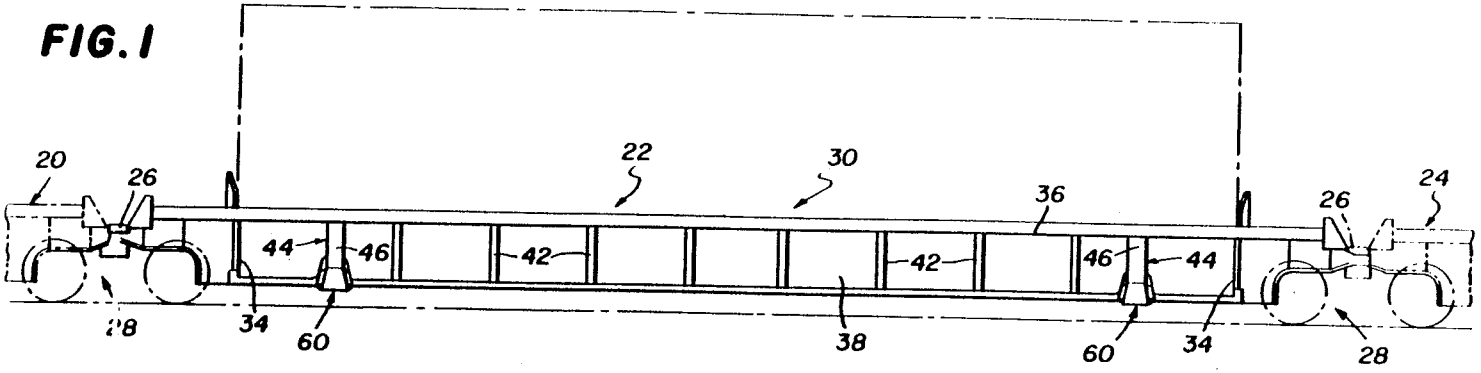
FIG. 1 is a side elevation of a well car for carrying containers according to the invention connected to similar cars at each end.
Figure 2:
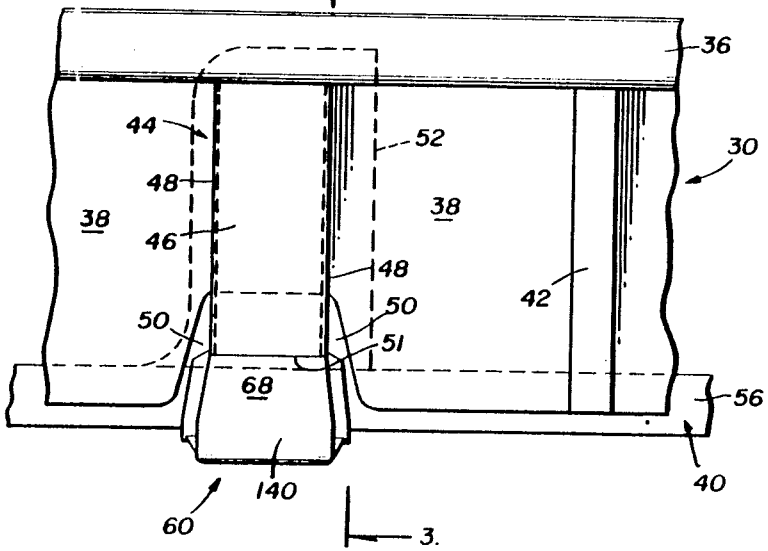
FIG. 2 is an enlarged elevational view of a side wall portion of the well car shown in FIG. 1.
Figure 3:
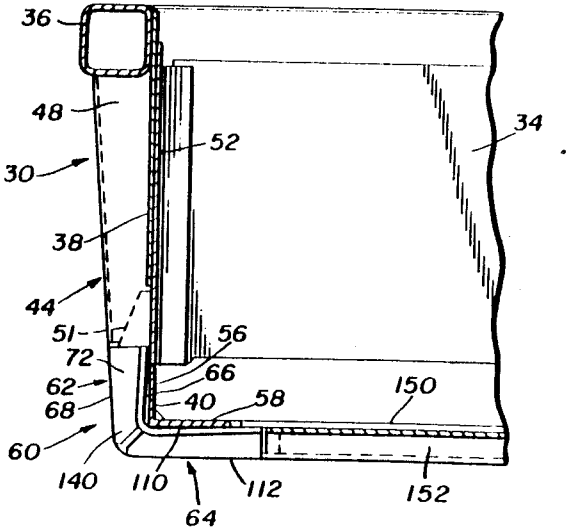
FIG. 3 is a sectional view taken along the line 3—3 of FIG. 2 showing a reinforcing elements or casting at the bottom of one well car side wall.
Figure 5:
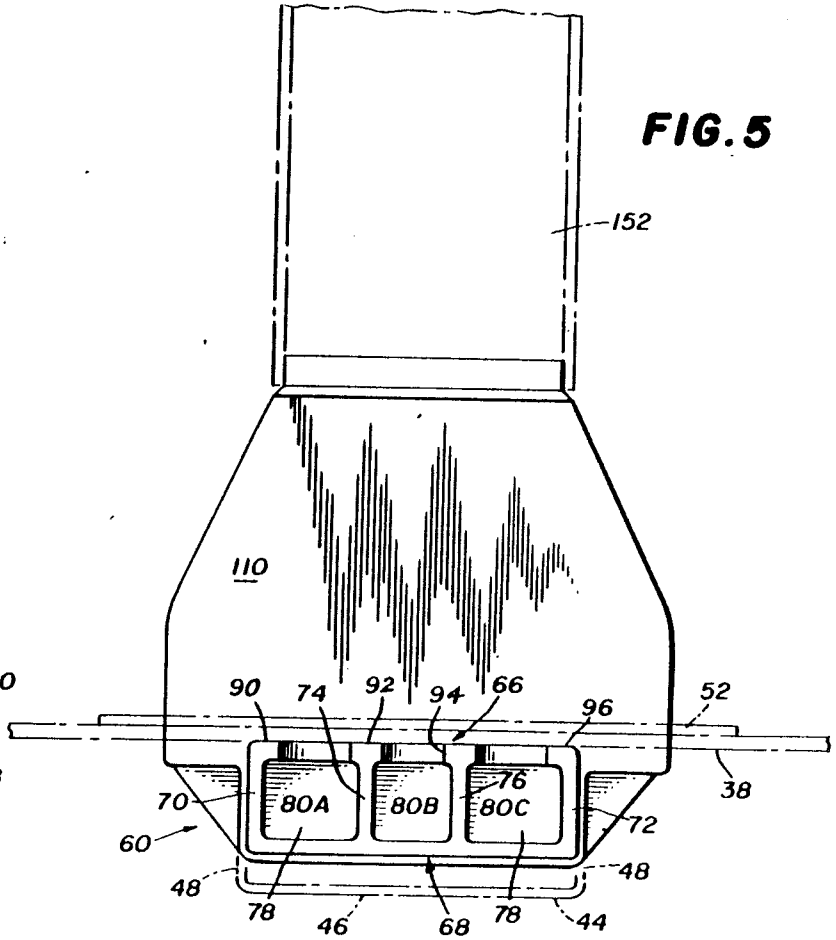
FIGS. 5 is an enlarged plan view of the casting shown in FIG. 4.
Figure 4:
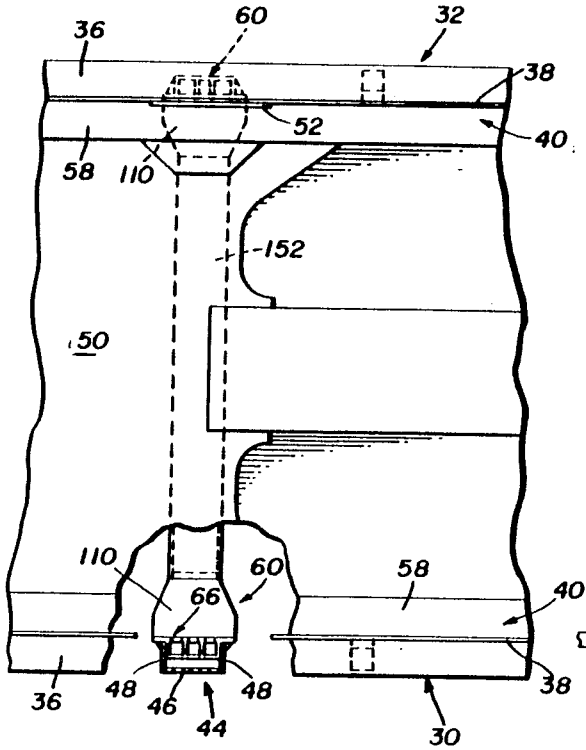
FIG. 4 is a plan view, partially in section and broken away, showing the location of opposing castings on the side walls of one of the well cars.
Figure 6:
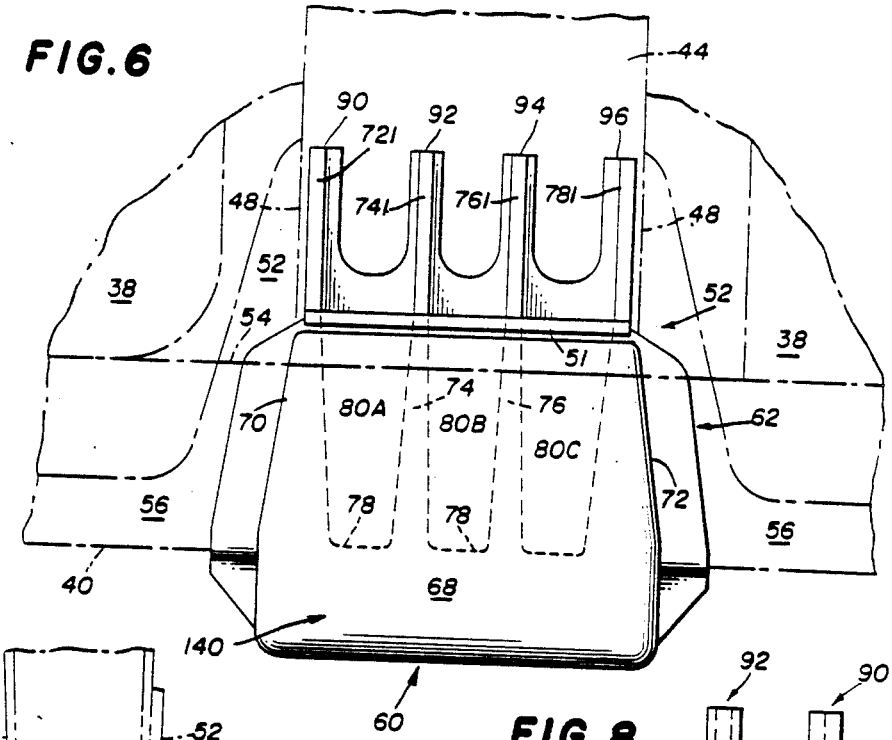
FIG. 6 is a front elevational view of the casting shown in FIG. 5.
Figure 7:
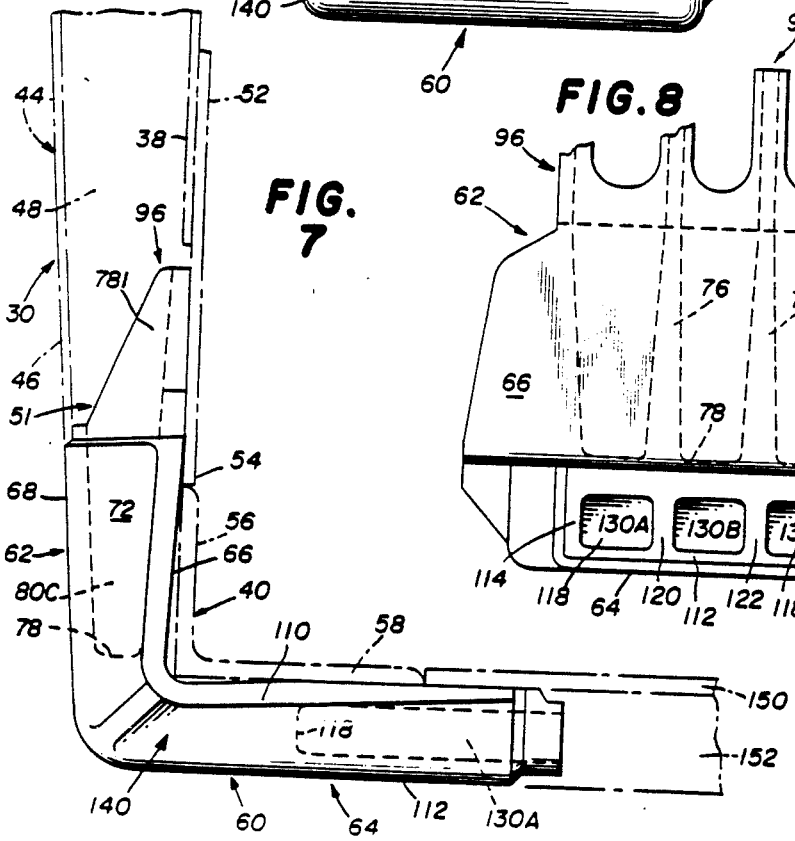
FIG. 7 is an enlarged side elevational view of the casting shown in FIGS. 4 to 6.

With reference to FIG. 1, identical well cars 20,22,24 are connected together by a commercially available articulated connector 26 which engages the bolster of a standard two axle four wheel railroad truck 28. It is intended that the cars remain connected together as in a unit train except for repairs and maintenance. It should be understood, however, that each car can have a conventional four wheel truck at each end so that it can be transported independently and be coupled to other types of cars of a train.

Well car 22 has a pair of identical longitudinal spaced apart parallel side walls, 30,32 and identical end walls 34 near each end of the car thereby defining a deep well space in which at least one cargo container can be transported. A well car of this general type is disclosed in U.S. Pat. No. 4,456,413.

Each side wall 30,32 has a tube 36 at the top. They function as major load bearing members. Additionally, each side wall 30,32 comprises a metal sheet or plate 38 extending from tube 36 downwardly and having a longitudinal horizontal angle member 40 at the bottom. The angle members 40 also function as load bearing members. A series of spaced apart vertical side wall braces 42 extend from each tube 36 to angle member 40 and are joined to plate 38.

Near each end of each side wall 30,32 is located a special vertical side brace 44 which extends from tube 36 to near but above the lower horizontal edge of sheet 38. The lower portion of sheet 38 has a three sided cut-out portion 50 which is located in the rear of the lower portion of brace 44. A reinforcement plate 52 is attached to the surface of plate 38 facing inside of the well in back of brace 44. The bottom edge 54 of reinforcement plate 52 is joined to the top edge of the vertical flange 56 of angle 40. The brace 44 has a front face 46 and two tapered or straight sides 48 which are joined to plate 38 and reinforcement plate 52 thus forming a tapered brace having a rectangular horizontal section with an open rectangular bottom end 51.

A one piece metal casting 60 is located at the lower end of each side brace 44. The casting 60 is desirably made of cast iron or cast steel. Each casting 60 has a substantially vertically located leg 62 and a horizontal arm 64 which extends inwardly facing toward the center of the car. The casting 60 thus has a generally right angle shape. The leg 62 is positioned in the cut-out portion 50 in side wall plate 38. The upper end of leg 62 fits into the open lower end 51 of side brace 44 and butts against and is welded to reinforcement plate 52 but does not contact side wall plate 38. The leg is welded to the lower end of side brace 44 and to the bottom portion of reinforcement plate 52 but not to side wall plate 38. The upper edge of flange 56 of angle 40 contacts the on top of arm 64 and the other edge of flange 58 of angle 40 contacts leg 62 but the arm 64 and leg 62 desirably are not welded or joined to angle 40. This permits the angle 40 and the casting to flex with respect to each other when under load thereby avoiding weld cracking and metal fatigue of the various members.

The casting vertical leg 62 has an inner flange 66 and an outer flange 68 substantially vertically positioned and spaced apart from each other but located longitudinal to the adjoining car body side wall. Two spaced apart substantially vertical webs 70,72 are located lateral to and joined to inner flange 66 and outer flange 68 thereby defining a vertical pocket open at the top and extending downwardly for less than the length of the leg 62. Two additional lateral spaced apart webs 74,76 are positioned between flanges 66,68 and extend down to the bottom 78 of the pocket. It will be seen that the four webs 70,74,76,72 divide the pocket into three separate small pockets 80A, 80B and 80C which together constitute a major pocket between webs 70,72.

A plurality of spaced apart substantially vertical fingers 90,92,94,96 can extend upwardly from the top of the inner flange 66 of leg 62 and be joined to reinforcement plate 52 forming part of the side wall. The fingers can be extensions of the inner flange 66 and each finger can be reinforced by an extension 721, 741, 761 and 781.

Figure 8:
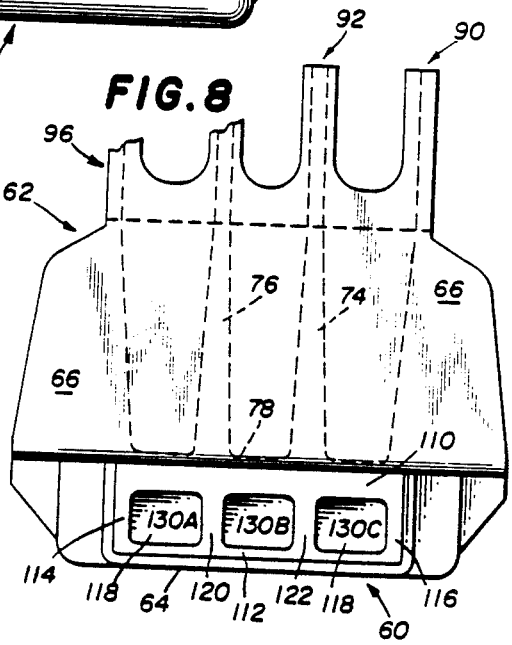
FIG. 8 is an end elevational view of the casting arm.

The casting lateral horizontal arm 64 has a top horizontal flange 110 and a lower or bottom horizontal spaced apart flange 112. Two spaced apart substantially vertical webs 114,116 are joined to flanges 110,112 thereby defining a major horizontal pocket open at the end of the arm. The pocket extends horizontally inwardly from the arm end for less than the length of the arm and ends at bottom 118. As shown in FIG. 8, the arm 64 has two additional spaced apart vertical webs 120,122 joined to the flanges 110,112, thereby dividing the major pocket into three smaller pockets 130A, 130B and 130C.

The leg inner flange 66 merges smoothly into the arm flange 110 and similarly the leg outer flange 68 merges into the arm bottom flange 112.

The casting 60 has a solid corner block of metal 140 for the width of the casting where the leg 62 and the arm 64 merge, with the solid block of metal extending to and forming the bottoms of the leg and arm pockets.

The bottom portion 51 of vertical side wall brace 44 covers the upper portion of casting leg 62 to below the root of fingers 90,92,94,96. The end of the brace 44 is welded along its three bottom edges to the casting.

A shear plate 150 is located at the bottom of the car well adjoining the end of the well. The shear plate 150 is joined to the angles 40 along each side wall. Lateral crossbeam 152 is positioned beneath shear plate 150 and joined thereto. The ends of crossbeam 152 are telescoped over the end portions of arms 64 of opposing castings and joined thereto by welding.

The casting embodiment shown in the drawings has the vertical webs in the casting leg and the vertical webs in the casting arm aligned with each other. Pairs of such aligned webs 70,72,114,116 form casting side walls on the leg and arm.

It will also be seen from the drawings that the leg outer flange 68 and the arm bottom flange 112 terminate at the said casting side walls and the leg inner flange 66 and the arm top flange 110 extend beyond the said casting side walls.

The foregoing detailed description has been given for clearness of understanding only, and no unnecessary limitations should be understood therefrom, as modifications will be obvious to those skilled in the art.

What is claimed is:

1. A railroad car for carrying containers comprising:

a car body supported by rail truck means adapted for movement over a railroad;

the car body having opposing side walls and an end wall near each end connected to the side walls with said side walls and end walls defining a well in which a container can be received;

means for supporting the bottom of a container, when in the well, comprising a plurality of spaced metal reinforcing elements joined to each side wall and spaced inwardly from the well end walls;

each reinforcing element being substantially L-shaped and having a substantially vertical leg joined at the bottom of a side wall and the reinforcing element having an arm extending laterally substantially horizontally inwardly toward the center of the car to aid in supporting a container in the well;

the reinforcing element vertical leg having inner and outer substantially vertical spaced apart flanges longitudinal to an adjoining car body side wall and at least two spaced apart substantially vertical webs lateral to and joined to the flanges thereby defining a vertical pocket open at the top and extending downwardly for less than the length of the leg;

the reinforcing element lateral horizontal arm having top and bottom substantially horizontal spaced apart flanges and at least two spaced apart substantially vertical webs joined to the flanges thereby defining a horizontal pocket open at the end of the arm and extending horizontally inwardly from the arm end for less than the length of the arm.

2. A railroad car according to claim 1 in which the leg has at least three spaced apart vertical webs joined to the inner and outer flanges thereby describing at least two vertical pockets.

3. A railroad car according to claim 1 in which the leg has at least four spaced apart vertical webs joined to the inner and outer flanges thereby describing at least three vertical pockets.

4. A railroad car according to claim 1 in which the arm has at least three spaced apart vertical webs joined to the top and bottom flanges thereby describing at least two horizontal pockets.

5. A railroad car according to claim 1 in which the arm has at least four spaced apart vertical webs joined to the inner and outer flanges thereby describing at least three horizontal pockets.

6. A railroad car according to claim 1 in which:

the leg has at least four spaced apart vertical webs joined to the inner and outer flanges thereby describing at least three vertical pockets; and the arm has at least four spaced apart vertical webs joined to the inner and outer flanges thereby describing at least three horizontal pockets.

7. A railroad car according to claim 1 in which the leg inner flange merges into the arm top flange and the leg outer flange merges into the arm bottom flange.

8. A railroad car according to claim 1 in which a plurality of spaced apart substantially vertical fingers extend upwardly from the leg inner flange top and the fingers are joined to the side wall.

9. A railroad car according to claim 8 in which the fingers are extensions of the inner flange and each finger is reinforced by an extension of a leg vertical web.

10. A railroad car according to claim 1 having a reinforcing element located near each side wall end opposite a reinforcing element on the other side wall and a lateral crossbeam connected to the arms of said opposing reinforcing elements.

11. A railroad car according to claim 1 in which the reinforcing element has a solid corner block of metal for the width of the reinforcing element where the leg and arm merge, with said solid block of metal extending to and forming the bottoms of the leg and arm pockets.

12. A railroad car according to claim 1 in which each side wall has vertical braces outside of the well and the leg of each reinforcing element is joined to a vertical brace vertically aligned with the leg.

13. A railroad car according to claim 12 in which the top of the leg telescopes into the vertical brace.

14. A railroad car according to claim 1 in which:

vertical webs in the leg and the arm are aligned with each other; and pairs of such aligned webs form side walls on the leg and the arm.

15. A railroad car according to claim 14 in which:

the leg outer flange and the arm bottom flange terminate at the said reinforcing element side walls; and the leg inner flange and the arm top flange extend beyond the said reinforcing element side walls.

16. A railroad car according to claim 1 having:

a longitudinal horizontal structural angle member having a vertical flange and a horizontal flange extending along the bottom of each side wall with the vertical flange joined to the side wall and the horizontal flange supported by the casting arm.

17. A railroad car according to claim 16 in which the angle member vertical flange is close to but is spaced from and is not joined to the reinforcing element leg.

18. A railroad car according to claim 16 in which the angle member horizontal flange bottom edge portion contacts the reinforcing element arm top flange but the horizontal flange and the reinforcing element top flange are otherwise out of contact with each other and not joined together

19. A railroad car for carrying containers comprising:

a car body supported by rail truck means adapted for movement over a railroad;

the car body having opposing side walls and an end wall near each end connected to the side walls with said side walls and end walls defining a well in which a container can be received;

means for supporting the bottom of a container, when in the well, comprising a plurality of spaced metal reinforcing elements joined to each side wall and spaced inwardly from the well end walls;

each reinforcing element having a substantially vertical leg joined at the bottom of a side wall and the reinforcing element having an arm extending laterally substantially horizontally inwardly toward the center of the car to aid in supporting a container in the well;

a longitudinal horizontal structural angle member having a vertical flange and a horizontal flange extending along the bottom of each side wall with the vertical flange joined to the side wall and the horizontal flange supported by the reinforcing element arm; and the angle member vertical flange not being joined to the reinforcing element leg.

20. A railroad car according to claim 19 in which the angle member horizontal flange bottom edge portion contacts the reinforcing element arm top flange but the horizontal flange and the reinforcing element top flange are otherwise out of contact with each other and not joined together.

21. A railroad car for carrying containers comprising:

a car body supported by rail truck means adapted for movement over a railroad;

the car body having opposing side walls and an end wall near each end connected to the side walls with said side walls and end walls defining a well in which a container can be received;

means for supporting the bottom of a container, when in the well, comprising a plurality of spaced metal reinforcing elements joined to each side wall and spaced inwardly from the well end walls;

each reinforcing element having a substantially vertical leg joined at the bottom of a side wall and the reinforcing element having an arm extending laterally substantially horizontally inwardly toward the center of the car to aid in supporting a container in the well;

a longitudinal horizontal structural angle member having a vertical flange and a horizontal flange extending along the bottom of each side wall with the vertical flange joined to the side wall and the horizontal flange supported by the reinforcing element arm; and the angle member horizontal flange bottom edge portion contacts the reinforcing element arm top flange but the horizontal flange and the reinforcing element top flange are otherwise out of contact with each other and not joined together.

22. A substantially L-shaped reinforcing element having a substantially vertical leg and a substantially horizontal arm;

the reinforcing element vertical leg having inner and outer substantially vertical spaced apart flanges and at least two spaced apart substantially vertical webs lateral to and joined to the flanges thereby defining a vertical pocket open at the top and extending downwardly for less than the length of the leg;

the reinforcing element horizontal arm having top and bottom substantially horizontal spaced apart flanges and at least two spaced apart substantially vertical webs joined to the flanges thereby defining a horizontal pocket open at the end of the arm and extending horizontally inwardly from the arm end for less than the length of the arm.

23. A reinforcing element according to claim 22 in which the leg has at least three spaced apart vertical webs joined to the inner and outer flanges thereby describing at least two vertical pockets.

24. A reinforcing element according to claim 22 in which the leg has at least four spaced apart vertical webs joined to the inner and outer flanges thereby describing at least three vertical pockets.

25. A reinforcing element according to claim 22 in which the arm has at least three spaced apart vertical webs joined to the top and bottom flanges thereby describing at least two horizontal pockets.

26. A reinforcing element according to claim 22 in which the arm has at least four spaced apart vertical webs joined to the inner and outer flanges thereby describing at least three horizontal pockets.

27. A reinforcing element according to claim 22 in which:

the leg has at least four spaced apart vertical webs joined to the inner and outer flanges thereby describing at least three vertical pockets; and the arm has at least four spaced apart vertical webs joined to the inner and outer flanges thereby describing at least three horizontal pockets.

28. A reinforcing element according to claim 22 in which the leg inner flange merges into the arm top flange and the leg outer flange merges into the arm bottom flange

29. A reinforcing element according to claim 22 in which a plurality of spaced apart substantially vertical finger extend upwardly from the leg inner flange.

30. A reinforcing element according to claim 29 in which the fingers are extensions of the inner flange and each finger is reinforced by an extension of a leg vertical web.

31. A reinforcing element according to claim 22 in which the reinforcing element has a solid corner block of metal for the width of the reinforcing element where the leg and arm merge, with said solid block of metal extending to and forming the bottoms of the leg and arm pockets.

32. A reinforcing element according to claim 22 in which:

vertical webs in the leg and the arm are aligned with each other; and pairs of such aligned webs form side walls on the leg and the arm.

33. A reinforcing element according to claim 32 in which:

the leg outer flange and the arm bottom flange terminate at the said reinforcing element side walls; and the leg inner flange and the arm top flange extend beyond the said reinforcing element side walls.

* * * * *

UNITED STATES PATENT AND TRADEMARK OFFICE

CERTIFICATE OF CORRECTION

PATENT NO. : 4,949,646

DATED : August 21, 1990

INVENTOR(S) : Richard E. Jamrozy and Shaun Richmond

It is certified that error appears in the above-identified patent and that said Letters Patent is hereby corrected as shown below:

In column 1, line 5, after "application" add the following: -- is a continuation of pending application Serial No. 07/180,316, filed April 11, 1988, which in turn --.

In column 1, line 6, after "1986," add: -- now U.S. Patent No. 4,771,706 issued September 20, 1988, --.

Column 9, claim 29, line 5, after the word flange and before the period, insert -- top --.

Signed and Sealed this

Twenty-sixth Day of May, 1992

*Attest:*

DOUGLAS B. COMER

*Attesting Officer*

*Acting Commissioner of Patents and Trademarks*